US009920283B2

(12) United States Patent
Preuschen et al.

(10) Patent No.: US 9,920,283 B2
(45) Date of Patent: Mar. 20, 2018

(54) COMPOSITION

(71) Applicant: RECKITT BENCKISER FINISH B.V., Hoofddorp (NL)

(72) Inventors: Judith Preuschen, Ludwigshafen (DE); Ralf Wiedemann, Mira (IT)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 0 days.

(21) Appl. No.: 15/262,831

(22) Filed: Sep. 12, 2016

(65) Prior Publication Data

US 2016/0376528 A1 Dec. 29, 2016

Related U.S. Application Data

(60) Continuation of application No. 13/099,009, filed on May 2, 2011, now Pat. No. 9,441,189, which is a continuation of application No. 12/604,590, filed on Oct. 23, 2009, now abandoned, which is a division of application No. 12/092,671, filed as application No. PCT/GB2006/004149 on Nov. 7, 2006, now abandoned.

(30) Foreign Application Priority Data

Nov. 7, 2005 (GB) ..... 0522658.4

(51) Int. Cl.

| | |
|---|---|
| ***B08B 3/04*** | (2006.01) |
| ***C11D 3/33*** | (2006.01) |
| ***C11D 3/39*** | (2006.01) |
| ***C11D 3/395*** | (2006.01) |
| ***C11D 3/20*** | (2006.01) |
| ***C11D 3/37*** | (2006.01) |
| ***C11D 3/386*** | (2006.01) |

(52) U.S. Cl.

CPC ..... *C11D 3/2086* (2013.01); *C11D 3/2082* (2013.01); *C11D 3/33* (2013.01); *C11D 3/378* (2013.01); *C11D 3/38609* (2013.01); *C11D 3/3955* (2013.01)

(58) Field of Classification Search

CPC ..... C11D 3/2082; C11D 3/33; C11D 3/378; C11D 3/39; C11D 3/395; C11D 7/265; B08B 3/04

See application file for complete search history.

(56) References Cited

U.S. PATENT DOCUMENTS

| | | | | |
|---|---|---|---|---|
| 3,875,070 | A | 4/1975 | Von Praun et al. | |
| 4,132,735 | A | 1/1979 | Lamberti et al. | |
| 4,349,447 | A | 9/1982 | Noguchi et al. | |
| 5,547,612 | A | 8/1996 | Austin et al. | |
| 5,786,313 | A | 7/1998 | Schneider et al. | |
| 5,824,630 | A | 10/1998 | Christie et al. | |
| 5,929,012 | A | 7/1999 | Del Duca et al. | |
| 5,968,884 | A | 10/1999 | Gopalkrishnan | |
| 5,977,053 | A | 11/1999 | Groth et al. | |
| 5,998,346 | A | 12/1999 | Welch et al. | |
| 6,159,922 | A * | 12/2000 | Williams | C11D 3/3942 134/25.2 |
| 6,162,259 | A | 12/2000 | Williams et al. | |
| 6,194,373 | B1 | 2/2001 | Saito et al. | |
| 8,163,686 | B2 * | 4/2012 | Gibis | C11D 3/33 134/25.2 |
| 2003/0158078 | A1 * | 8/2003 | Chang | C11D 3/3746 510/475 |
| 2004/0116319 | A1 | 6/2004 | Nitsch et al. | |

FOREIGN PATENT DOCUMENTS

| | | | |
|---|---|---|---|
| DE | 3829847 | A1 | 3/1990 |
| DE | 3833047 | A1 | 4/1990 |
| DE | 10313172 | A1 | 10/2004 |
| EP | 0509382 | A2 | 10/1992 |
| EP | 0550087 | A1 | 7/1993 |
| EP | 0659871 | A1 | 6/1995 |
| EP | 0851022 | A2 | 7/1998 |
| EP | 0882786 | A1 | 12/1998 |
| EP | 0913461 | A1 | 5/1999 |
| EP | 1111037 | A1 | 6/2001 |
| EP | 1113070 | A2 | 7/2001 |
| EP | 1721962 | A1 | 11/2006 |
| GB | 1439518 | A | 6/1976 |
| GB | 2311536 | A | 10/1997 |
| JP | 2000063894 | A | 2/2000 |
| JP | 2001003089 | A | 1/2001 |
| WO | 9500624 | A1 | 1/1995 |
| WO | 9723450 | A1 | 7/1997 |
| WO | 9736983 | A1 | 10/1997 |
| WO | 9736990 | A1 | 10/1997 |
| WO | 9749792 | A1 | 12/1997 |
| WO | 9813467 | A1 | 4/1998 |
| WO | 9902636 | A1 | 1/1999 |

(Continued)

OTHER PUBLICATIONS

Technical Bulletin, "Trilon M Liquid Chelating Agent," BASF, 2003.

Provisional Technical Information "Trilon ES 9964 Organic Chelating Agent for Detergents and Cleaners, for the Chemical and Allied Industries, and for Other Branches of Industry," BASF, May 1995

International Search Report in related International Application No. PCT/GB2006/004149, dated Feb. 5, 2007.

International Preliminary Report on Patentability in related International Application No. PCT/GB2006/004149, dated Jan. 16, 2008

SOFW vol. 122, 1996, pp. 392-396.

(Continued)

*Primary Examiner* — Brian P Mruk

(74) *Attorney, Agent, or Firm* — Troutman Sanders LLP; Ryan Schneider; Chris Davis

(57) ABSTRACT

A dishwasher detergent composition, preferably pH neutral, and comprising a strong biodegradable builder and optionally a bleach, and optionally a sulfonated polymer.

9 Claims, No Drawings

(56) References Cited

FOREIGN PATENT DOCUMENTS

| | | | | | |
|---|---|---|---|---|---|
| WO | 0058228 | A1 | | 10/2000 | |
| WO | 0172941 | A1 | | 10/2001 | |
| WO | 0204583 | A1 | | 1/2002 | |
| WO | 0220708 | A1 | | 3/2002 | |
| WO | 03006594 | A1 | | 1/2003 | |
| WO | 03042347 | A1 | | 5/2003 | |
| WO | 2004099091 | A1 | | 11/2004 | |
| WO | 2005090541 | A1 | | 9/2005 | |
| WO | 2006106332 | A1 | | 10/2006 | |
| WO | WO 2007/052004 | | * | 5/2007 | ..... C11D 17/00 |

OTHER PUBLICATIONS

Technical information, ACUMER 3100 Terpolymer: The Anti-Scale Deposition for "Stressed" Cooling Water Conditions, Rohm & Haas, 1999.

* cited by examiner

COMPOSITION

CROSS-REFERENCE TO RELATED APPLICATIONS

This application is a continuation of U.S. patent application Ser. No. 13/099,009, now issued as U.S. Pat. No. 9,441,189, filed on 2 May 2011, which is a continuation of U.S. patent application Ser. No. 12/604,590, filed on 23 Oct. 2009, which is a divisional of U.S. patent application Ser. No. 12/092,671, filed on 30 May 2008, which is a U.S. National Stage Entry of PCT/GB2006/004149, filed on 7 Nov. 2006, which claims the benefit of Great Britain Patent Application No. 0522658.4, filed on 7 Nov. 2005, the disclosures of each of which are herein incorporated by reference in their entirety.

BACKGROUND OF THE INVENTION

The invention relates to a detergent composition for machine dishwashing.

In recent years there has been an ever increasing trend towards safer and environmentally friendly detergent compositions. This has led to development of alternative complexing agents (builders), which are used instead of predominantly phosphorous based builders. Phosphate builders can be connected with eutrophication issues.

On the other hand phosphates can bind calcium and magnesium ions, can act as alkalinity source for the detergent, they are used to buffer the wash liquor in a dishwasher above pH 9 together with other chemicals such as disilicate, metasilicates and soda.

Phosphates are also able to disperse existing calcium carbonate in the wash liquor to prevent spotting on glasses.

Thus, replacing phosphates in a detergent means to compensate at least four different functions in an alkaline detergent. (1) providing alkalinity; (2) buffering capacity, (3) complexing of magnesium and calcium ions; and (4) dispersing capacity of calcium carbonate The use of more environmentally friendly biodegradable complexing agents, such as β-alaninediacetic acid (β-ADA) and isoserinediacetic acid (ISDA) in detergents is disclosed in DE-A-3,829,847 and DE-A-4,036,995.

However, these compounds have low complexing action and only a poor replacement for the conventional builders in the finished composition.

Other documents disclosing the use of biodegradable builders in detergent compositions include EP-A-550,087 which discloses a biodegradable oxydisuccinate builder in detergent compositions and WO 97/23450 which discloses biodegradable cysteic monosuccinic acid builder in detergent compositions. JP2000063894 and JP2001003089 disclose glutamic diacetic acid builder in detergent compositions. U.S. Pat. No. 4,132,735 discloses detergent compositions comprising biodegradable acrylate polymer builders.

One other environmentally friendly builder that has been used in dishwasher detergent formulations are salts of citric acid. This has the advantage that these salts are biodegradable, and environmentally friendly. However, the builder performance of citric acid salts is far inferior to that of phosphorus based builders. Additionally this poor performance is even further compromised with increasing temperature: salts of citric acid display especially poor activity above 45° C.

Indeed the dishwasher detergents proposed to date which use environmentally friendly complexing agents have the disadvantage that they are only effective at a relatively high pH. In order to provide this high pH, pH adjusting agents usually need to be added to the composition. These pH adjusting agents can act as additional buffering system, but cause side problems of filming and spotting on dishes. Repeated wash cycles can also lead to glass and machine corrosion, and lime-scale build-up, even on dishes.

It is an object of the invention to obviate/mitigate the issues outlined above and/or to offer detergent compositions with usage and/or environmental benefits.

According to the present invention there is provided a dishwasher detergent composition comprising a strong biodegradable builder.

BRIEF SUMMARY OF THE INVENTION

In one aspect of the present invention, the invention provides a method of machine dishwashing, comprising supplying a dishwasher detergent composition to a dishwasher machine, wherein the dishwasher detergent composition comprises a strong biodegradable builder.

In some embodiments, the composition comprises a sulfonated polymer.

In some embodiments, the sulfonated polymer is a polymer or copolymer which includes, as a monomer unit or the monomer unit, a compound of formula $$CH_2{=}CR^1{-}CR^2R^3{-}O{-}C_4H_3R^4{-}SO_3X,$$

wherein $R^1$, $R^2$, $R^3$, $R^4$ are independently 1 to 6 carbon alkyl or hydrogen, and X is hydrogen or alkali.

In other embodiments, the sulfonated polymer, includes, as a monomer unit or as the monomer unit, 2-acrylamido-2-methyl-1-propanesulfonic acid.

In still other embodiments, the sulfonated polymer is present in the composition in an amount of 0.5 wt % to 40 wt %.

In another embodiment, the composition yields a pH-neutral liquid washing medium.

In yet another embodiment, the composition yields an alkaline liquid washing medium.

In an embodiment, the strong biodegradable builder is present in the composition in an amount of 0.1 wt % to 65 wt %.

In another embodiment, the strong biodegradable builder is an amino acid based compound or a succinic acid based compound.

In some embodiments, the amino acid based compound is selected from methyl-glycine-diacetic acid and salts thereof and glutamic-N,N-diacetic acid and salts thereof.

In another embodiment of the invented method, the composition comprises a secondary builder selected from homopolymers and copolymers of polycarboxylic acids and their partially or completely neutralized salts, monomeric polycarboxylic acids and hydroxycarboxylic acids and their salts, and from phosphates and phosphonates, and combinations thereof.

In some embodiments, the secondary builder is organic.

In other embodiments, the composition comprises polyhydroxycarboxylic acid containing 2-4 carboxyl groups or a salt thereof.

In still other embodiments, the composition comprises no inorganic secondary builder.

In yet other embodiments, the composition comprises a bleach, wherein the bleach is selected from at least one of: an inorganic perhydrate, an organic peracid, and/or salts thereof, and combinations thereof.

In another embodiment, the composition comprises 0.01 to 3 wt % of one or more enzymes.

In some embodiments, the one or more enzymes are selected from protease, lipase, amylase, cellulase and peroxidase enzymes.

These and other objects, features and advantages of the present invention will become more apparent upon reading the following specification in conjunction with the accompanying description, claims and drawings.

DETAILED DESCRIPTION OF THE INVENTION

Definitions

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, particularly with respect to biological systems or processes, the term can mean within an order of magnitude, preferably within 2-fold, of a value. Where particular values are described in the application and claims, unless otherwise stated, the term "about" is implicit and in this context means within an acceptable error range for the particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, do not denote any order, quantity, or importance, but rather are used to distinguish one element from another.

It is noted that terms like "specifically," "preferably," "typically," "generally," and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

Compositions and Methods of the Invention

According to the present invention there is provided a dishwasher detergent composition comprising a strong biodegradable builder.

Preferred embodiments of the invention produce pH-neutral washing liquors. For the purposes of this specification pH-neutral is defined as pH 5 to pH 8, more preferably from pH 5.5 to pH 7.8 and most preferably from pH 6 to pH 7.7, especially pH 7 to 7.6; when dissolved 1:100 (wt:wt, composition:water) in de-ionised water at 20° C., measured using a conventional pH meter.

Other embodiments of the invention produce alkaline washing liquors. For the purposes of this specification alkaline is defined as pH greater than 8. A preferred pH range is pH 8.5 to pH 11; when dissolved 1:100 (wt:wt, composition:water) in de-ionised water at 20° C., measured using a conventional pH meter.

Surprisingly, it has been found that compositions according to the invention have excellent properties. In particular the detergents have been found to effectively remove food residues combined with the ability to prevent or even to remove the build-up of precipitates formed by Ca- and Mg-ions; such as limescale.

Further, compositions of the invention have been found to be particularly good in preventing scale deposition and/or in rinse properties.

Further, certain compositions of the invention have been found to have an advantage over comparator compositions not of the invention, in terms of their ability to be press-formed into solid bodies such as tablets.

Preferably the composition has a solids content of more than 25%, preferably more than 50%.

The composition may, for example, be in the form of a tablet, rod, ball or lozenge. The composition may be a particulate form, loose or pressed to shape or may be formed by injection moulding or by casting or by extrusion. The composition may be encased in a water soluble wrapping, for, example of polyvinyl alcohol (PVOH) or a cellulosic material. The composition may be a gel.

Preferably the strong biodegradable builder is present in the composition in an amount of at least 0.1 wt %, preferably at least 0.5 wt %, more preferably at least 1 wt %, and most preferably at least 4 wt %.

Preferably the strong biodegradable builder is present in the composition in an amount of up to 65 wt %, preferably up to 50 wt %, more preferably up to 30 wt %, and most preferably up to 15 wt %.

Most preferably the strong biodegradable builder is an amino acid based compound or a succinate based compound. Preferred examples of amino acid based compounds include MGDA (methyl-glycine-diacetic acid, and salts thereof) and glutamic-N,N-diacetic acid. Preferred succinate compounds are described in U.S. Pat. No. 5,977,053 and have the formula

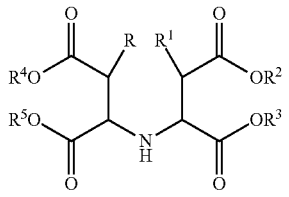

in which

R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Compositions of the invention containing MGDA have been found to be particularly well suited to being press-formed into solid bodies such as tablets.

Preferably a secondary builder (or cobuilder) is present in the composition. Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of succinic acid, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another specific secondary builder for dishwasher detergents which can be mentioned is a polymer, derived from aspartic acid

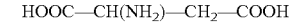

containing monomer units of the formula

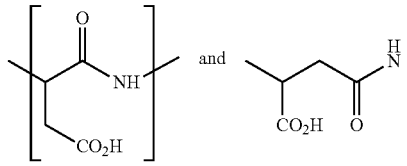

Another suitable polycarboxylic acid is the homopolymer of acrylic acid.

Other suitable builders are disclosed in WO 95/01416, to the contents of which express reference is hereby made.

Particular preference is given to a builder system of the salt of a hydroxycarboxylic acid or of the mixture of a hydroxycarboxylic acid and the salt of a hydroxycarboxylic acid. Both the hydroxycarboxylic acid and the salt of the hydroxycarboxylic acid could be replaced completely or partially by tripolyphosphate.

However, although phosphorus-containing secondary builders may be present in this invention, preferred compositions have no phosphorus-containing compound(s).

The builder system preferably consists of a hydroxypolycarboxylic acid containing 2-4 carboxyl groups (or acidic inorganic salts), which can be mixed with its salt to adjust the pH. Citric acid or a mixture of sodium citrate with citric acid is preferably used. For adjustment of the pH, which may be required to provide a composition within the range defined in this invention, mixtures having a major proportion of citric acid, for example, are suitable, depending on the other constituents of the mixture.

Sulfonated polymers are suitable for use in the present invention. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in Sulfonated (co)polymers are 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof.

Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %.

When a sulfonated polymer is present, it is preferably present in the composition in an amount of up to 40 wt %, preferably up to 25 wt %, more preferably up to 15 wt %, and most preferably up to 10 wt %.

Sulfonated polymers are used in detergency applications as polymers to disperse Ca-phosphate compounds and prevent their deposition. To our surprise we have found them to give cleaning benefits in combination even with preferred phosphorus-free compositions of the present invention.

A bleach may be present in a composition of the invention.

When a bleach is present, it is preferably present in the composition in an amount of at least 1 wt %, more preferably at least 2 wt %, more preferably at least 4 wt %.

When a bleach is present, it is preferably present in the composition in an amount of up to 30 wt %, more preferably up to 20 wt %, and most preferably up to 15 wt %.

Most preferably a bleach is selected from inorganic perhydrates or organic peracids and the salts thereof.

Examples of inorganic perhydrates are persulfates such as peroxymonopersulfate (KMPS). Perborates or percarbonates are not excluded but are less favoured. The inorganic perhydrates are normally alkali metal salts, such as lithium, sodium or potassium salts, in particular sodium salts. The inorganic perhydrates may be present in the detergent as crystalline solids without further protection. For certain perhydrates, it is however advantageous to use them as granular compositions provided with a coating which gives the granular products a longer shelf life.

A percarbonate may be present but is less preferred. When one is present the preferred percarbonate is sodium percarbonate of the formula $2Na_2CO_3.3H_2O_2$. A percarbonate, when present, is preferably used in a coated form, to increase its stability.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

The dishwasher detergent according to the invention and containing a bleach can also comprise one or more bleach activators. These are preferably used in detergents for dishwashing cycles at temperatures in the range below 60° C. in order to achieve an adequate bleaching action. Particularly suitable examples are N- and O-acyl compounds, such as acylated amines, acylated glycolurils or acylated sugar compounds. Preference is given to pentaacetylglucose (PAG) and tetraacetylglycoluril (TAGU). Also favoured are ammonium nitrile compounds of formula 1 below:

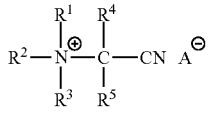

in which $R^1$, $R^2$, and $R^3$ are the same of different and can be linear or branched $C_{1-24}$ alkyl, $C_{2-24}$ alkenyl, or $C_{2-4}$-$C_{1-4}$ alkyl groups, or substituted or unsubstituted benzyl; or wherein $R^1$ and $R^2$ together with the nitrogen atom from a ring structure. Other suitable bleach activators are, however, catalytically active metal complexes and, preferably, transition metal complexes. Other suitable bleach activators are disclosed in WO 95/01416 (various chemical classes) and in EP-A-1 209 221 (cyclic sugar ketones).

Usually the detergent composition comprises other conventional dishwasher detergent components.

For example the composition may contain surface active agents such as an anionic, non-ionic, cationic, amphoteric or zwitterionic surface active agents or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

One possible class of nonionic surfactants are ethoxylated non-ionic surfactants prepared by the reaction of a monohydroxy alkanol or alkylphenol with 6 to 20 carbon atoms with preferably at least 12 moles particularly preferred at least 16 moles, and still more preferred at least 20 moles of ethylene oxide (EO) per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one preferred embodiment of the invention, the non-ionic surfactants additionally comprise propylene oxide (PO) units in the molecule. Preferably these PO units constitute up to 25% by weight, preferably up to 20% by weight and still more preferably up to 15% by weight of the overall molecular weight of the non-ionic surfactant. Particularly preferred surfactants are ethoxylated mono-hydroxy alkanols or alkylphenols, which additionally comprises polyoxyethylene-polyoxypropylene block copolymer units. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_X[CH_2CH_2O]_Y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention for instances mixtures of alkoxylated alcohols and hydroxy group containing alkoxylated alcohols.

Other suitable surfactants are disclosed in WO 95/01416, to the contents of which express reference is hereby made.

The dishwasher detergent according to the invention can also comprise one or more foam control agents. Suitable foam control agents for this purpose are all those used in this field, such as, for example, silicones and paraffin oil.

The foam control agents are preferably present in the dishwasher detergent according to the invention in amounts of less than 5% by weight of the total weight of the detergent.

The dishwasher detergent according to the invention can also comprise a source of acidity or a source of alkalinity, to obtain the desired pH, on dissolution. A source of acidity may suitably be any of the components mentioned above, which are acidic; for example polycarboxylic acids. A source of alkalinity may suitably be any of the components mentioned above, which are basic; for example any salt of a strong base and a weak acid. However additional acids or bases may be present. In the case of alkaline compositions silicates may be suitable additives. Preferred silicates are sodium silicates such as sodium disilicate, sodium metasilicate and crystalline phyllosilicates.

The dishwasher detergent according to the invention can also comprise a silver/copper corrosion inhibitor. This term encompasses agents which are intended to prevent or reduce the tarnishing of non-ferrous metals, in particular of silver and copper. Preferred silver/copper corrosion inhibitors are benzotriazole or bis-benzotriazole and substituted derivatives thereof.

Other suitable agents are organic and/or inorganic redox-active substances and paraffin oil.

Benzotriazole derivatives are those compounds in which the available substitution sites on the aromatic ring are partially or completely substituted. Suitable substituents are linear or branch-chain $C_{1-20}$-alkyl groups and hydroxyl, thio, phenyl or halogen such as fluorine, chlorine, bromine and iodine. A preferred substituted benzotriazole is tolyltriazole.

Suitable bis-benzotriazoles are those in which the benzotriazole groups are each linked in the 6-position by a group X, where X may be a bond, a straight-chain alkylene group which is optionally substituted by one or more $C_{1-4}$-alkyl groups and preferably has 1-6 carbon atoms, a cycloalkyl radical having at least 5 carbon atoms, a carbonyl group, a sulfuryl group, an oxygen atom or a sulfur atom. The aromatic rings of the bis-benzotriazoles may be substituted as defined above for benzotriazole.

Suitable organic redox-active substances are, for example, ascorbic acid, indole, methionine, an N-mono-($C_1$-$C_4$-alkyl) glycine, an N,N-di-($C_1$-$C_4$-alkyl)glycine, 2-phenylglycine or a coupler and/or developer compound chosen from the group consisting of diaminopyridines, aminohydroxypyridines, dihydroxypyridines, heterocyclic hydrazones, aminohydroxypyrimidines, dihydroxypyrimidines, tetraaminopyrimidines, triaminohydroxypyrimidines, diaminodihydroxypyrimidines, dihydroxynaphthalenes, naphthols, pyrazolones, hydroxyquinolines, aminoquinolines, of primary aromatic amines which, in the ortho-, meta- or paraposition, have another hydroxyl or amino group which is free or substituted by $C_1$-$C_4$-alkyl or $C_2$-$C_4$-hydroxyalkyl groups, and of di- or trihydroxybenzenes.

Suitable inorganic redox-active substances are, for example, metal salts and/or metal complexes chosen from the group consisting of manganese, titanium, zirconium, hafnium, vanadium, cobalt and cerium salts and/or complexes, the metals being in one of the oxidation states II, III, IV, V or VI.

Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$.

Organic and inorganic redox-active substances which are suitable as silver/copper corrosion inhibitors are also mentioned in WO 94/26860 and WO 94/26859, to the contents of which reference is hereby made.

Suitable paraffin oils are predominantly branched aliphatic hydrocarbons having a number of carbon atoms in the range from 20 to 50. Preference is given to the paraffin oil chosen from predominantly branched-chain $C_{25-45}$ species having a ratio of cyclic to noncyclic hydrocarbons of from 1:10 to 2:1, preferably from 1:5 to 1:1.

If a silver/copper corrosion inhibitor is present in the dishwasher detergent according to the invention, it is preferably present in an amount of from 0.01 to 5% by weight, particularly preferably in an amount of from 0.1 to 2% by weight, of the total weight.

Other customary additives are, for example, dyes and perfumes and optionally in the case of liquid products, preservatives, suitable examples of which are compounds based on isothiazolinone.

The composition preferably comprises one or more enzymes, preferably selected from protease, lipase, amylase, cellulase and peroxidase enzymes. Such enzymes are commercially available and sold, for example, under the registered trademarks Esperase™, Alcalase™ and Savinase™ by Nova Industries A/S and Maxatase™ by International Biosynthetics, Inc. Desirably the enzyme(s) is/are present in the composition in an amount of from 0.01 to 3 wt %, especially 0.01 to 2 wt % (active enzyme(s) present).

The composition is described with reference to the following non-limiting Examples.

EXAMPLES

The present invention is also described and demonstrated by way of the following examples. However, the use of these and other examples anywhere in the specification is illustrative only and in no way limits the scope and meaning of the invention or of any exemplified term. Likewise, the invention is not limited to any particular preferred embodiments described here. Indeed, many modifications and variations of the invention may be apparent to those skilled in the art upon reading this specification, and such variations can be made without departing from the invention in spirit or in scope. The invention is therefore to be limited only by the terms of the appended claims along with the full scope of equivalents to which those claims are entitled.

Dispersing Capacity of Complexing Agents

Method: Determination of calcium carbonate dispersing capacity

1. Dissolve 1 g product (=builder) in 100 ml deionized water.
2. Neutralize, if necessary, with 1M NaOH.
3. Add 10 ml of a 10% Na2CO3 solution
4. Adjust pH to 10 with NaOH or HCl as required.
5. Keep pH and temperature constant during titration.
6. Titrate with 0.25M calcium acetate solution until the solution becomes turbid.

This method is in accordance with the scientific paper by F. Richter and E. W. Winkler, published in Tenside Detergent, 1987, 4, pp. 213-216.

| Builder | $CaCO_3$ dispersing capacity in mg/g builder at 25° C. | | Buffering capacity |
|---|---|---|---|
| STPP (Benchmark) | 252 | 240 | YES |
| MGDA | 344 | 259 | NO |
| Dissolvine | 250 | 234 | NO |
| IDS | 227 | 130 | NO |
| Trisodium citrate | 158 | 31 | NO |

MGDA: (Methyl Glycine-N,N-diacetic acid), sodium salt, Trilon M ™ from BASF.
Dissolvine ™: (N,N-diacetic-glutamic acid), sodium salt, from Akzo Nobel.
IDS: Imino-disuccinate, sodium salt, Baypure CX 100 ™ from Lanxess.

All dispersing values were measured at pH 10.

It can be seen from the results that MGDA and Dissolvine are as good as or better than the phosphate regarding the dispersing capacity at room temperature and at 50° C. (dishwash cycle temperature).

IDS is a little less effective at pH 10.

Citrate cannot compensate for STPP at all, because it cannot disperse calcium carbonate at 50° C.

Overall, this measurement gives an indication that citrate alone cannot replace STPP, but can act as a base material for a dishwasher detergent formulation.

Citrate needs to be combined with a material that shows less temperature sensitive behaviour such as Dissolvine, MGDA or IDS.

The missing buffering capacity can be compensated for by formulating a base of citrate and its acid form.

Formulation Examples

A base formulation (powder) was prepared as below.

| Component | Wt % |
|---|---|
| Strong Biodegradable Builder | 5.0 |
| Sodium Citrate | 69.8 |
| Citric acid | 2.0 |
| PAP bleach | 7.0 |
| Amylase*1 | 0.4 |
| Protease*2 | 1.1 |
| Sulfonated polymer*3 | 5.0 |
| PEG 6000 | 2.0 |
| PEG 1500 | 7.0 |
| Surfactant*4 | 0.5 |
| BTA | 0.1 |
| Perfume | 0.1 |

*1Duramyl ™
*2Properase ™
*3Sulfonated polyacrylic acid copolymer Acusol 587 ™, Acusol 588 ™ or Alcoguard 4080 ™ may be substituted.
*4$C_{16-18}$ fatty alcohol 3EO-3PO For formulation 1 the builder was MGDA, supplied as Trilon M™ from BASF.

For formulation 2 the builder was (N,N-diacetic-glutamic acid), supplied as Dissolvine™ from Akzo Nobel.

For formulation 3 the builder was Imino-disuccinate, supplied as Baypure CX 100™ from Lanxess.

Formulation 4 has only sodium citrate 75% as builder.

The formulations all had a pH of 7.5. Minor amounts of the citric acid were added or subtracted from the 2 wt % value in order to achieve the pH value.

Application Examples

The builder capability (and other cleaning capabilities) was tested in a Miele 651 dishwashing machine using a 50° C. cycle Normal, according to the method IKW. In each case 20 g of the powder was added to the dosing chamber of the dishwasher. The water hardness was 21° gH. The results (given in Table 1) are expressed on a scale of 1-10 (1 being worst and 10 being best).

TABLE 1

| Stain | Formulation 1 | Formulation 2 | Formulation 3 | Formulation 4 |
|---|---|---|---|---|
| Bleachable (Tea) | 7.5 | 7.6 | 7.0 | 5.9 |
| Starch - dried on oat flakes | 8.0 | 7.8 | 7.5 | 7.5 |
| Starch - dried on starch mix | 9.3 | 9.6 | 9.8 | 9.4 |
| Protein - dried on minced meat | 6.7 | 6.5 | 5.7 | 6.7 |
| Burnt-on (milk) | 5.9 | 6.1 | 5.9 | 5.8 |
| | Av. 7.4 | Av. 7.5 | Av. 7.1 | Av. 7.0 |

These results show that the strong biodegradable builders provide excellent cleaning results even at pH 7.5.

To increase the performance of the bleach and the protease, the concentration of those components can be increased.

In detail, we find much better results on tea stains, with the formulations of the invention compared with the know formulation, formulation 4. This is probably due to better $CaCO_3$-dispersing properties of strong organic builders compared with the pure citrate formulation 4. In other tests the results were generally good, for all four formulations.

While several possible embodiments are disclosed above, embodiments of the present invention are not so limited.

These exemplary embodiments are not intended to be exhaustive or to unnecessarily limit the scope of the invention, but instead were chosen and described in order to explain the principles of the present invention so that others skilled in the art may practice the invention. Indeed, various modifications of the invention in addition to those described herein will become apparent to those skilled in the art from the foregoing description. Such modifications are intended to fall within the scope of the appended claims. Further, the terminology employed herein is used for the purpose of describing exemplary embodiments only and the terminology is not intended to be limiting since the scope of the various embodiments of the present invention will be limited only by the appended claims and equivalents thereof. The scope of the invention is therefore indicated by the following claims, rather than the foregoing description and above-discussed embodiments, and all changes that come within the meaning and range of equivalents thereof are intended to be embraced therein.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

All patents, applications, publications, test methods, literature, and other materials cited herein are hereby incorporated by reference in their entirety as if physically present in this specification.

What is claimed is:

1. A method of machine dishwashing, comprising supplying a solid dishwasher detergent composition to a dishwasher machine, wherein the dishwasher detergent composition is free of phosphates and comprises:

a strong biodegradable builder selected from the group consisting of methyl-glycine-diacetic acid and salts thereof and glutamic-N,N-diacetic acid and salts thereof;

a water-soluble citrate salt; and a bleach;

wherein said composition has a pH in range of 5.5 to 7.8, when dissolved 1:100 (wt:wt, composition:water) in de-ionized water at 20° C.

2. The method as claimed in claim 1, wherein the composition comprises a sulfonated polymer.

3. The method as claimed in claim 2, wherein the sulfonated polymer is a polymer or copolymer which includes, as a monomer unit or the monomer unit, a compound of formula $$CH_2{=}CR^1{-}CR^2R^3{-}O{-}C_4H_3R^4{-}SO_3X$$

wherein $R^1$, $R^2$, $R^3$, $R^4$ are independently 1 to 6 carbon alkyl or hydrogen, and X is hydrogen or alkali.

4. The method as claimed in claim 2, wherein the sulfonated polymer, includes, as a monomer unit or the monomer unit, 2-acrylamido-2-methyl-1-propanesulfonic acid.

5. The method as claimed in claim 2, wherein the sulfonated polymer is present in the composition in an amount of 0.5 wt % to 40 wt %.

6. The method as claimed in claim 1, wherein the strong biodegradable builder is present in the composition in an amount of 0.1 wt % to 65 wt %.

7. The method as claimed in claim 1, wherein the bleach is selected from at least one of: an inorganic perhydrate, an organic peracid, and/or salts thereof, and combinations thereof.

8. The method as claimed in claim 1, wherein the composition comprises 0.01 to 3 wt % of one or more enzymes.

9. The method as claimed in claim 8, wherein the one or more enzymes are selected from protease, lipase, amylase, cellulase and peroxidase enzymes.

* * * * *